United States Patent [19]

Bogese et al.

[11] 4,314,737

[45] Feb. 9, 1982

[54] CABLE ASSEMBLY HAVING SHIELDED CONDUCTOR AND METHOD OF MAKING SAME

[75] Inventors: Charles E. Bogese, Roanoke County; Stephen B. Bogese, II, Roanoke, both of Va.

[73] Assignee: Virginia Patent Development Corp., Roanoke, Va.

[21] Appl. No.: 48,636

[22] Filed: Jun. 14, 1979

[51] Int. Cl.[3] ..... H01R 13/38; H01B 7/34

[52] U.S. Cl. ..... 339/99 R; 174/36; 174/103; 174/106 SC; 174/117 F

[58] Field of Search ..... 174/36, 103, 115, 117 F, 174/106 SC; 339/99 R

[56] References Cited

U.S. PATENT DOCUMENTS

| | | | |
|---|---|---|---|
| 2,211,584 | 8/1940 | Rubem | 174/102 |
| 3,291,891 | 12/1966 | Sharp | 174/103 X |
| 3,297,814 | 1/1967 | McClean | 174/36 |
| 3,639,674 | 2/1972 | Stier | 174/36 |
| 3,775,552 | 11/1973 | Schumacher | 174/36 X |
| 3,794,752 | 2/1974 | Bunish | 174/36 X |
| 3,816,644 | 6/1974 | Giffel | 174/36 X |
| 4,002,392 | 1/1977 | Hardesty | 339/99 R |
| 4,025,715 | 5/1977 | Foley | 174/36 |

*Primary Examiner*—Richard R. Kucia
*Attorney, Agent, or Firm*—Saidman & Sterne

[57] ABSTRACT

A cable assembly having a shielded conductor and a method of making same. The shielded conductor is formed by bonding a thin layer of conductive material to the outer surface of an insulated wire. The bonding may be achieved by coating the outside surface of the insulated wire with a metallic particle and solvent solution, and then heating the coated wire to flash off the solvent and achieve the desired bond. The outer conductive layer may be grounded by positioning grounding means adjacent thereto prior to encapsulation in an outer insulating jacket. The grounding means preferably takes the form of a center ground wire surrounded by a semi-conductive material whose outer diameter is substantially the same as that of the shielded conductor. The semi-conductor material contacts the outer conductive layer along its length, and physical and electrical contact is maintained by the outer jacket. One or more unshielded insulated conductors may also be provided within the cable assembly, which is particularly adapted for easy termination in a standard, miniature modular plug that utilizes insulation-piercing conductive terminals.

18 Claims, 6 Drawing Figures

FIG. 1
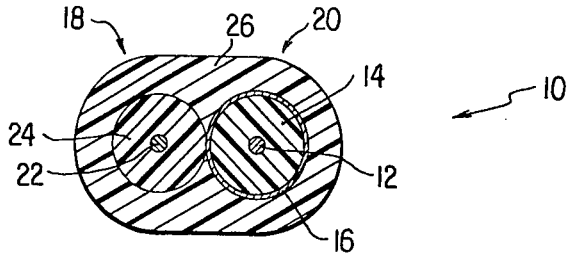
FIG. 2
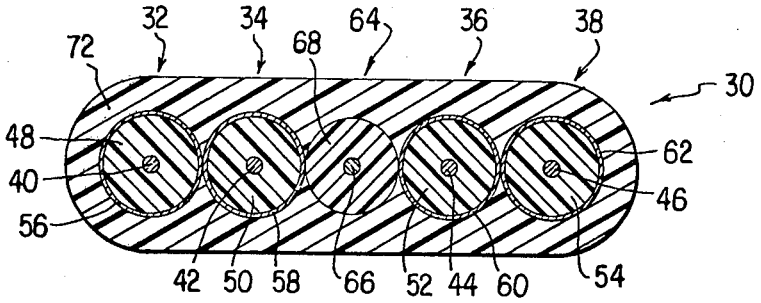
FIG. 3
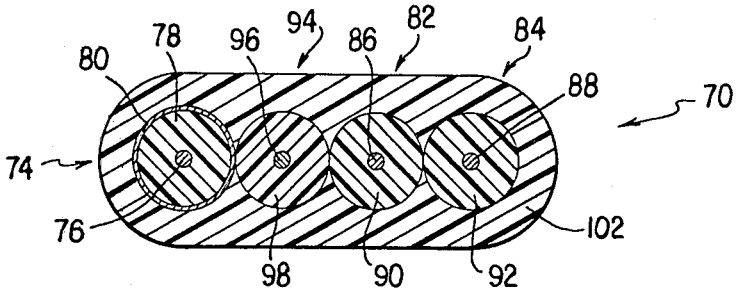
FIG. 4
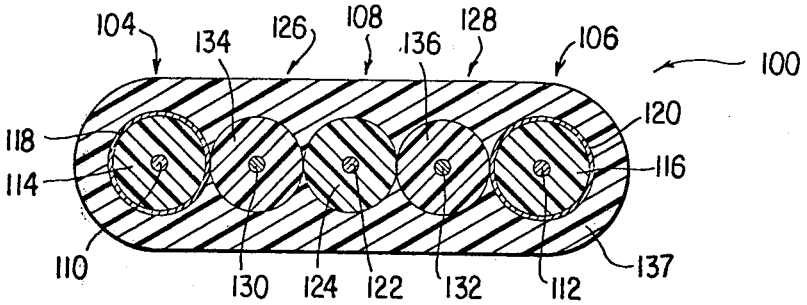
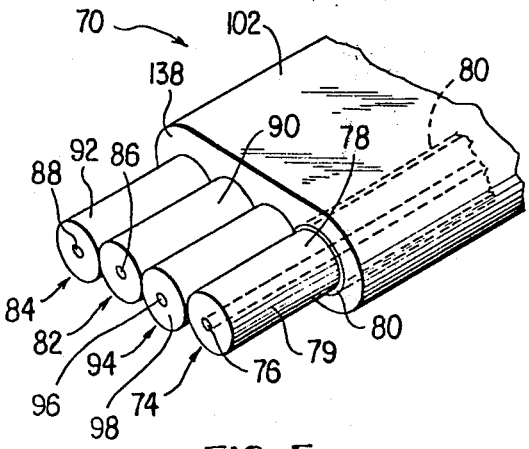
FIG. 5
FIG. 6
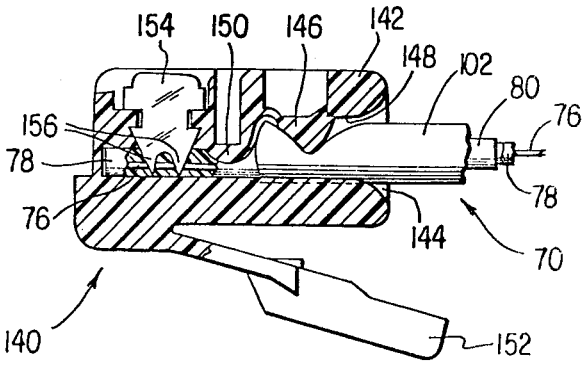

CABLE ASSEMBLY HAVING SHIELDED CONDUCTOR AND METHOD OF MAKING SAME

BACKGROUND OF THE INVENTION

1. Field of the Invention

The present invention relates to cable constructions and, more particularly, is directed towards a cable assembly having at least one shielded conductor, as well as to a method of making and using same in combination with a standard, telephone-type modular plug.

2. Description of the Prior Art

A wide variety of cable assemblies that have one or more shielded conductors are known. Such cable assemblies are utilized in various applications where it is necessary to shield a low level, information-bearing electrical signal from spurious external electrical interference. It is well known that such shielding may be accomplished by surrounding the information carrying conductor with a metal shield that, in one fashion or another, is externally grounded. Such a grounded shield effectively prevents the signal on the wire from being distorted by externally generated electrical noise or other interference.

Miniature modular plugs and mating jacks have recently gained wide popularity, especially in the telephone industry. Such miniature plugs, as examplified by U.S. Pat. No. 4,002,392 to Hardesty, are characterized by their ability to rapidly terminate a multi-conductor cable. A typical multi-conductor cable utilized with such plugs comprises a substantially planar array of conductors which are individually insulated and are then encapsulated in an outer jacket to maintain precise physical positioning thereof. A portion of the outer jacket is removed to expose the ends of the insulated conductors prior to insertion into a modular plug, and subsequent termination. Termination is achieved by individually piercing each of the insulated conductors with a small, flat insulation-piercing conductive terminal which becomes locked in place in the plug. The plug also includes means for securely gripping and thereby retaining the jacketed portion of the cable, and may also provide strain-relief means for the unjacketed terminated insulated conductors.

One advantage of the modular plugs described above is that, after termination of a multi-conductor cable therein, the plug may be rapidly connected and disconnected to a mating jack, as is well known in the art. An integral locking tab is provided on the plug for maintaining same securely within the jack, and for readily releasing the plug from the jack when desired.

While widely utilized in the telephone industry, such miniature plugs and jacks have a small but steadily increasing market in other applications, such as those which simply require a low signal level (e.g. 12 volts) interconnect cable between two pieces of electrical equipment. The low level signals on such cables frequently, however, must be transmitted in an environment where shielding of one or more of the insulated conductors is desirable, or even critical, to ensure preservation of the information content of the signals transmitted in the conductors. However, despite the growing need, a practical and inexpensive multi-conductor cable, having one or more shielded insulated conductors, which may be utilized with the popular miniature, modular telephone-style plugs, has yet to be developed.

Several different types of shielded cables are commonly known, but each suffers from one or more disadvantages as respects their cost, ease of termination, cable flexibility, or quick-disconnect ability. One common construction employs a plurality of metal strands which are either braided or wrapped in a spiral fashion about one or more insulated conductors. One disadvantage of such a construction is that the extra thickness of the metal strands makes the resulting shielded conductor considerably larger than an equivalent unshielded conductor. Thus, if both a shielded and unshielded conductor are jacketed in a single cable, the unequally sized conductors result in an unbalanced construction which is difficult to jacket smoothly and uniformly, and may therefore require specialized equipment for manufacture. Further, connection to the shield is slow and therefore quite costly from a labor standpoint. For a braided shield, for example, the individual braids must be manually unwoven, and then manipulated to one side of the cable and terminated, usually by soldering. For a wrapped shield, the wrapped strands must be unfurled from the insulated conductor, and then twisted together for termination. These types of constructions simply do not lend themselves to be rapidly terminated, especially in a miniature, modular, telephone-style plug which is designed to receive precisely aligned conductors of a predetermined size, and which also terminate the conductors by piercing the insulation, rather than by soldering. The oversized braided or wrapped shielded conductors described above simply do not fit into such modular plugs.

Another common type of shielded cable utilizes a semiconductive plastic material applied over one or more insulated conductors. The semi-conductive material is generally extruded around the insulation of the conductor desired to be shielded. The thinness wall thickness, however, that can be extruded is approximately 0.004 inch. While relatively thin when compared with the metal stranded shielded conductors described above, such a thickness nevertheless also results in an unbalanced construction and oversized conductors, thereby admitting of some of the same problems described above with respect to the metal strand shields. Further, connection techniques for such plastic shields have not been fully perfected and leave much to be desired from the standpoints of quality and reliability. These oversized shielded conductors also do not fit within the standard telephone-type modular plugs.

A third type of shielded cable assembly is exemplified by the construction described in U.S. Pat. No. 3,775,552 to Schumacher. Such a construction utilizes a metal foil and polymer laminate which surrounds both the insulated conductor and a drain wire which is externally grounded. The drain wire contacts the foil-polymer laminate to provide the desired shielding of the insulated conductor positioned therewithin. The presence of the drain wire causes the shielded conductor to be eccentric, making it larger than a corresponding unshielded conductor, which results in an unbalanced construction as described hereinabove for the other prior art assemblies. Further, the foil shield cannot be terminated without the metal drain wire. To attempt to utilize such a construction in a miniature, telephone-style modular plug would require the foil shield to be unfurled and then cut off along with the drain wire. More importantly, the cross-sectional geometry of such a cable does not at all lend itself to termination in such a plug.

U.S. Pat. Nos. 277,248, 2,211,584 and 3,287,490 deal with the application of a conductive coating on a single insulated wire. The thicknesses of such coatings, however, make the resultant products impractical for incorporation in a multi-conductor cable that can be terminated in a modular plug.

Other prior art United States patents which relate generally to cable constructions or coatings include U.S. Pat. Nos.: 1,976,804; 2,161,395; 2,287,947; 3,211,821; 3,594,228; 3,792,192; 4,079,156; 4,081,602; and 4,130,854. However, none of the structures described in these patents solve the problems noted above.

OBJECTS OF THE INVENTION

It is therefore a primary object of the present invention to provide a novel and unique cable assembly having at least one shielded conductor which overcomes all of the disadvantages noted above with respect to prior art designs.

Another object of the present invention is to provide a cable assembly which includes at least one shielded conductor which is neither oversized nor results in an unbalanced cable construction when jacketed with other unshielded conductors.

A further object of the present invention is to provide a novel cable assembly wherein a shielded conductor may be provided having substantially the same outer diameter as an unshielded conductor, which results in a smooth and uniform cable that can be assembled with standard equipment and which further may be sized to as to easily fit in a standard, telephone-style, miniature, modular plug.

An additional object of the present invention is to provide a multi-conductor assembly which includes at least one shielded conductor, the cable assembly being particularly designed to be rapidly terminated in a miniature, modular, telephone-style plug.

A still further object of the present invention is to provide a novel and unique method of making a shielded conductor and cable assembly wherein the resultant product is more uniform and precisely sized than can be produced by prior art techniques.

A still additional object of the present invention is to provide a novel technique for making a shielded conductor which results in an extremely thin, yet effective, metallic shield being formed over a standard insulated conductor.

Another object of the present invention is to provide a cable assembly that utilizes a unique shielded conductor and means for grounding same which are both substantially uniform and equal size to permit use with existing cable assembly equipment that results in a uniform and precision end product for use with known cable terminating devices.

Another object of the present invention is to provide a novel and unique cable assembly with at least one shielded conductor which is extremely flexible, is easily terminated, and may be adapted to be utilized with a device for providing a quick-disconnect from electrical equipment.

Another general and important object of the present invention is to provide a cable assembly having at least one shielded conductor which is particularly designed for rapid termination in a standard miniature telephone-type plug so that the cable assembly may be utilized as a low signal level interconnect cable between various pieces of electrical equipment and which prevents spurious electrical interference from destroying the information content in the cable without substantially increasing the size thereof. An advantage which results from this feature is that standard tooling, wires and connectors, normally utilized only with unshielded conductor cables, may be readily employed during manufacture and use.

SUMMARY OF THE INVENTION

The foregoing and other objects are attained in accordance with one aspect of the present invention through the provision of apparatus which comprises a shielded wire assembly that includes means for transmitting an electrical signal, insulation means for covering the wire means along its length, means for shielding the wire means against outside electrical interference which comprises a thin layer of conductive material bonded to the insulation means, and grounding means comprising a semi-conductive material covering a ground wire and in contact with said thin layer of conductive material along its length.

Jacket means preferably covers the semi-conductive material and shielded wire assembly for maintaining physical and electrical contact therebetween. The jacket means in a preferred embodiment comprises an insulating jacket extruded over the semi-conductive material and the shielded wire assembly. The outer diameters of the semi-conductive material and the insulation means are preferably approximately the same.

In accordance with more specific aspects of the present invention, the thickness of the layer of conductive material is preferably less than 0.001 inch, preferably on the order of 0.0003–0.0004 inch. The layer of conductive material comprises a metal, such as silver.

In accordance with other aspects of the present invention, there may be provided at least one unshielded wire assembly having an additional conductive wire covered by insulation. There may further be provided a second unshielded wire assembly substantially identical to the first unshielded wire assembly. The grounding means may be positioned between the first unshielded wire assembly and the shielded wire assembly.

In accordance with another aspect of the present invention, there is provided a cable assembly which comprises a shielded wire assembly, means for grounding the shielded wire assembly and at least one unshielded wire assembly, wherein the shielded wire assembly comprises conductive wire means covered by insulation means, and means for shielding the wire means against outside electrical interference which comprises a layer of conductive material bonded to the insulation means, the grounding means being in contact with the conductive material. The grounding means preferably comprises a ground wire covered by a semi-conductive material that is in contact with the conductive material. Jacket means covers the shielded wire assembly, the semi-conductive material and the unshielded wire assembly for maintaining same in a substantially planar array. The semi-conductive material is preferably positioned between the shielded wire assembly and the unshielded wire assembly. The unshielded wire assembly preferably comprises an additional conductive wire means covered by additional insulation means, and the diameters of the shielded wire assembly, the semi-conductive material and the one unshielded wire assembly are substantially the same. There may further be provided a second unshielded wire assembly substantially identical to the first unshielded wire assembly and positioned adjacent same within the jacket means.

In accordance with another aspect of the present invention, a method is provided for terminating an end of the shielded wire cable set forth above, which comprises the steps of removing a portion of the jacket means at an end of the cable assembly to expose the shielded wire assembly, the semiconductive material and the unshielded wire assembly, removing the conductive material from the exposed portion of the shielded wire assembly, and attaching electrical terminal means to the conductive wire means, ground wire and the additional conductive wire means in the exposed portions thereof. The method further contemplates the step of positioning the exposed portions of the shielded wire assembly, the semi-conductive material and the unshielded wire assembly within a miniature modular plug after the conductive material is removed but before the electrical terminal means are attached. The step of attaching electrical terminal means includes the steps of piercing each of the insulation means, the semi-conductive material and the additional insulation means with individual conductive terminals. The step of removing the conductive material may comprise the step of scraping the conductive material off of the outer surface of the insulation means.

The present invention further contemplates the combination of a multi-conductor cable having at least one shielded wire assembly as described above along with a miniature, modular plug adapted to receive and retain the cable assembly, the plug including a plurality of insulation-piercing conductive terminals each adapted to make electrical contact with one of the center conductors of the cable assembly. The shielded wire assembly in this combination includes an end portion thereof stripped of the conductive material, such portion being adapted to be pierced by one of the conductive terminals.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a cross-sectional view of one preferred embodiment of the cable assembly of the present invention;

FIG. 2 is a cross-sectional view illustrating an alternate embodiment of the cable assembly of the present invention;

FIG. 3 is a cross-sectional view of yet another alternate embodiment of the cable assembly of the present invention;

FIG. 4 is a cross-sectional view of yet another alternate embodiment of the cable assembly of the present invention;

FIG. 5 is a perspective, fragmentary view of an end portion of the preferred embodiment of the present invention of FIG. 3 illustrated in a form ready for termination; and FIG. 6 is a side-sectional view illustrating the cable of FIG. 5 terminated in a standard, modular miniature telephone-style plug.

DETAILED DESCRIPTION OF THE PREFERRED EMBODIMENTS

Referring now to the drawings, wherein like reference numerals represent identical or corresponding parts throughout the several views, and more particularly to FIG. 1 thereof, there is illustrated a first preferred embodiment of a cable assembly in accordance with the present invention that is indicated generally by reference numeral 10.

The cable assembly 10 comprises a single substantially cylindrical shielded wire assembly which is indicated generally by reference numeral 20. Positioned adjacent and in contact with the shielded wire assembly 20 is a substantially ground wire assembly indicated generally by reference numeral 18. The ground wire assembly 18 and the shielded wire assembly 20 are both encapsulated in a standard manner within an insulating jacket 26, which is typically extruded over assemblies 18 and 20. Jacket 26 may, for example, comprise polyvinylchloride (PVC).

The shielded wire assembly 20 of the present invention comprises a center conductor or wire 12 which is designed to transmit a low level information-bearing signal which needs to be shielded from extraneous electrical interference in order to maintain the integrity of the information. Conductor 12 is surrounded by an insulation 14, which may typically comprise PVC, a polyolefin (such as polyethylene), or an elastomer.

In accordance with the present invention an extremely thin conductive layer 16 is bonded to the outside surface of insulation 14. The thickness of conductive layer 16 is somewhat exaggerated in the drawings, since it is preferably on the order of 0.0003–0.0004 inch. Generally, the thickness of the conductive layer 16, produced in a manner to be described in greater detail hereinafter, is less than 0.001 inch, sufficient to provide the desired low resistivity necessary to shield the low-level (e.g. 12 volt) signals on wire 12, and is typically around an order of magnitude thinner than the thinnest shields of the prior art.

The material from which conductive layer 16 is formed is preferably metallic, such as silver, copper, aluminum, or the like. Silver is presently preferred due to its high conductivity.

The ground wire assembly 18 preferably comprises a center conductor or wire 22 which is externally connected to ground. Ground wire 22 is surrounded by a semi-conductive material 24, which is preferably formed of a semi-conductive polymer, such as semi-conductive PVC or semi-conductive polyethylene. Alternatively, a semi-conductive rubber could be utilized. As is well known, a polymer or rubber can be made semi-conductive by the addition of a high amount of conductive filler, such as carbon black. Such materials are well known in the art.

The semi-conductive material 24 is in physical and electrical contact with the thin conductive layer 16 of the shielded wire assembly 20 along its entire length to thereby provide an effectively grounded shield for the signal carrying conductor 12.

The diameter of the semi-conductive material 24 is preferably substantially the same as that of the shielded wire assembly 20, which provides a uniform geometry over which the jacket 26 may be easily extruded by conventional techniques and equipment. Alternatively, however, the ground wire assembly 18 may consist of any suitable grounding means, such as a single drain wire, or the like. The configuration of FIG. 1 is preferred, however, both for its uniformity in construction and to facilitate termination, as will become more clear hereinafter.

The thin conductive layer 16 of the shielded wire assembly 20 may be formed of any of a number of techniques. In accordance with one method of the present invention, the wire 12 and insulation 14 are initially dipped in a liquid bath which consists of a mixture of fine matallic particles, such as silver, in a solvent. After being coated with the metal-solvent mixture, the insulation 14 is then placed in a heated chamber. The high temperature of the heated chamber flashes off the solvent and bonds the conductive layer 16 to the outside surface of insulation 14.

After heating, the shielded wire assembly 20 may be wound on a spool for temporary storage. Jacket 26 may be extruded about shielded wire assembly 20 and ground wire assembly 18 by conventional techniques and equipment.

Many different metal-solvent solutions may be utilized within the scope of the present invention. The exact nature of the metal-solvent solution is not critical as long as the desired metal thickness of bond results. For example, Type HCP, PE INK, Silver, manufactured by the Gem Gravure Company of West Hanover, Mass., may be employed when utilizing a polyethylene insulation 14. Type HCP PE INK, Silver, is comprised of 30% base pigment (silver), 16.5% binder, and 53% solvent, the latter being a mixture of ketohexamethylene and isopropyl acetone. The silver-solvent solution is prepackaged and ready to use, and may be placed in a tank through which the polyethylene insulation 14 is drawn. The thickness of the conductive layer 16 will generally be proportional to the time the insulation 14 is in the tank. For example, an immersion time of from approximately 15 to 20 seconds at room temperature provides a conductive layer 16 of approximately 0.0003–0.0004 inch.

After being withdrawn from the solution, the assembly 20 is drawn through a chamber heated at approximately 300° F. for approximately 60–120 seconds. This flashes off the solvent which results in the layer 16 being completely bonded to the outer surface of insulation 14. The finished product may then be wound onto a take-up spool.

If insulation 14 comprises PVC, for example, a different product known as Type G PVC, INK, Silver, manufactured by the same company may be utilized. This product comprises 30% base pigment (silver), 16% binder and 53% solvent which is hexamethylene. Other solvents, such as cyclohexanone, could also be used with PVC insulation.

If the insulation 14 comprises polyethylene, chemical or physical pre-treatment of the outer surface thereof may be desirable to enhance the adhesive bond of the conductive layer 16. For example, pre-treatment may be achieved by running the insulation 14 through a heated tunnel that causes the surface thereof to soften somewhat and thereby become tacky. This has been found to provide a greater adhesion for conductive layer 16 to be subsequently coated thereon.

Alternatively, an intermediate pre-treatment material may be applied to the outer surface of insulation 14. Such pre-treatment material, while not attacking the outer surface of insulation 14, nevertheless provides a better surface to which the conductive layer 16 will bond. The thickness of a layer of such a pre-treatment material on insulation 14 is quite small, in fact, microscopic, and adds negligibly to the size of the finished product. A typical pre-treatment material which may be utilized with a polyethylene insulation is a chlorinated polyolefin manufactured by Eastman.

If, however, the insulation 14 comprises, for example, PVC, no pre-treatment thereof may be necessary, since PVC is readily attacked by the solvent in the metal-solvent bath to provide a microscopically rough surface to which the residual metal particles may readily bond.

As an alternative to chemical pre-treatment, the surface of insulation 14 may be flame treated to roughen the surface, without distorting same, to provide a better bond for the conductive layer 16.

As further alternatives to the coating and heating technique described hereinabove, the conductive layer 16 may be bonded to insulation 14 by, for example, vacuum metallization or vapor deposition, techniques that are well known in the art.

Referring now to FIG. 2, an alterante embodiment of a cable assembly in accordance with the present invention is indicated generally by reference numeral 30. Cable 30 comprises four shielded wire assemblies which are indicated generally by reference numerals 32, 34, 36 and 38. Each of the shielded wire assemblies 32–38 are analogous in construction to the shielded wire assembly 20 of FIG. 1. Each includes a center conductor or wire 40, 42, 44 and 46 respectively, which are surrounded by insulations 48, 50, 52 and 54. Thin conductive layers 56, 58, 60 and 62 are bonded onto the outer surfaces of insulations 48, 50, 52 and 54, respectively.

In the center of cable 30 is positioned a ground wire assembly 64, which is analogous in construction to ground wire assembly 18 of FIG. 1, and comprises a center ground conductor or wire 66 surrounded by a semi-conductive material 68. Note that the semi-conductive material 68 contacts metal shields 58 and 60 along their entire length, while metal shields 56 and 62 lie adjacent to and in physical and electrical contact with metal shields 58 and 60, respectively, so that each of the metallic layers 56–62 are properly grounded. A PVC jacket 72 may be extruded over all of the conductors to maintain proper physical and electrical contact. The cable 30 of FIG. 2 may be utilized where, for example, four information-bearing conductors 40, 42, 44 and 46 require shielding.

Referring now to FIG. 3, there is illustrated yet another alternative embodiment of a cable assembly in accordance with the present invention which is indicated generally by reference numeral 70. Cable assembly 70 comprises a single shielded wire assembly indicated generally by reference numeral 74 which includes a center conductor 76, an insulation 78 and a thin conductive layer 80 bonded to the outside surface of insulation 78.

Positioned adjacent shielded wire assembly 74 is a ground wire assembly 94 which comprises a grounded center conductor 96 surrounded by a semi-conductive material 98 that is in physical and electrical contact with the thin metal layer 80 of the shielded wire assembly 74.

Cable 70 also includes a pair of substantially cylindrical unshielded wire assemblies indicated generally by reference numerals 82 and 84. Each of the unshielded wire assemblies 82 and 84 comprises a center conductor 86 and 88, respectively, surrounded by an insulation 90 and 92. The material of insulations 90 and 92 may be the same as that utilized for insulation 78 of shielded wire assembly 74, such as PVC, polyethylene, or the like.

The various assemblies 74, 82, 84 and 94 are arranged in a substantially planar array prior to jacketing by outer insulation 102. Unshielded wire assemblies 82 and 84 may be utilized for electrical energy transmissions which do not require shielding, such as, for example, power lines for indicator lights, or the like. Insulations 90 and 92 prevent electrical contact between conductors 86 and 88, as well as between assemblies 82, 84 and semi-conductive material 98.

Referring now to FIG. 4, reference numeral 100 indicates a three-conductor cable assembly which comprises a pair of shielded wire assemblies indicated by reference numerals 104 and 106 which are positioned one on each end of the cable assembly 100. The third conductor cable is indicated by reference numeral 108 and comprises an unshielded wire assembly which electrically isolates shielded wire assemblies 104 and 106 by its positioning ground wire assemblies 126 and 128.

The shielded wire assemblies 104 and 106 each include a center conductor 110 and 112 for carrying information-bearing electrical signals. Center conductors 110 and 112 are surrounded by insulations 114 and 116 to the outer surfaces of which are bonded conductive layers 118 and 120, respectively.

The unshielded wire assembly 108 includes a center conductor 122 which may be utilized, for example, as an electrical power line, which is surrounded by insulation 124.

Ground wire assemblies 126 and 128 each include a center ground wire 130 and 132 which are respectively surrounded by semi-conductive material 134 and 136.

The insulated conductors 104, 106 and 108 as well as the ground wire assemblies 126 and 128 are held in their physical and electrical relationship by an extruded outer jacket 137.

Referring now to FIG. 5, there is illustrated a perspective view of the cable 70 of FIG. 3 after having been prepared for termination. The jacket 102 is cut and stripped back approximately $\frac{3}{8}$ inch from the ends of the insulated conductors 74, 82 and 84 and from ground wire assembly 94, leaving a substantially flat face 138. Further, the conductive layer 80 around shielded wire assembly 74 is removed from the exposed portion 79 of insulation 78. Layer 80 may be removed from exposed portion 79 of insulation 78 by scraping same with a cutting tool, such as a knife or the like, or may alternatively be removed by a grinding wheel or similar abrasive device. The resultant construction of FIG. 5 leaves the metallic layer 80 intact within jacket 102, still in physical and electrical contact with the semi-conductive material 98 to provide shielding for that portion of center conductor 76 still within jacket 102. The exposed portion 79 is stripped of the metallic shield to prevent shorting of center conductor 76 during termination, as will now be described.

Referring now to FIG. 6, the cable of FIG. 5 is illustrated after installation in a standard, miniature, modulator telephone-type plug 140. The details of construction of a typical modular plug 140 are fully described in U.S. Pat. No. 4,002,392, which is incorporated herein by reference.

Briefly, plug 40 includes a dielectric housing 142 having a cable input aperture 144 positioned at one end thereof. A jacket-anchoring member 146 is moved into the position illustrated in FIG. 6 after the cable 70 has been fully inserted into plug 140 through the aperture 144. Anchoring member 146 is locked in position by bearing against the edge or corner 148 of housing 142 and serves to lock the cable 70 in place.

Plug 140 may also be provided with a strain relief element indicated by reference numeral 150. Strain relief element 150 is also moved to the position shown in FIG. 6 after the cable 70 has been fully inserted and terminated.

A resilient locking tab 152 extends integrally from the dielectric housing 142 to permit the plug 140 to be removably locked to a suitable matching miniature jack (not illustrated), as is well known to a person skilled in the art.

Plug 140 also includes a plurality of conductive terminals 154, which preferably comprise gold-plated bronze for high conductivity. In the view of FIG. 6, only one such terminal 154 is shown, although a plurality of such terminals, one for each of the insulated conductors, are provided.

The conductive terminal 154 includes insulation piercing tangs 156 to provide an electrical connection between each conductor, such as conductor 76 of shielded wire 74, the terminal 154 which, in turn, is adapted to make electrical contact with a mating terminal in a miniature jack.

It should be apparent from FIG. 6 that the pre-stripping of the outer metal shield 80 from the exposed portion 79 of insulation 78 of shielded wire assembly 74 prevents the conductive terminal 154 from shorting the wire 76 to the shield 80. Further, the cable 70 of the present invention is sized and particularly designed to fit within the modular plug 140. This adaptability is made feasible by the extremely thin conductive layer 80, the sizing of the semi-conductor ground 94 as well as the overall symmetrical cable construction which is no larger than an ordinary multi-conductor unshielded wire cable. It is understood that other shielded cable configurations, in addition to cable 70 of FIG. 3, may be adapted to be terminated in a modular plug, as the particular application may dictate.

Obviously, numerous modifications and variations of the present invention are possible in light of the above teachings. For example, the cable of the present invention may be terminated by other means, such as insulation-displacement spade, ring, barrel or circuit-board terminals. It is therefore to be understood that within the scope of the appended claims the invention may be practiced otherwise than as specifically described herein.

We claim as our invention:

1. A flat multi-conductor cable which comprises:

a conductive wire adapted to transmit an electrical signal;

cylindrical insulation covering said wire along its length;

means for shielding said wire against outside electrical interference which comprises a thin metallic layer of conductive material bonded to said insulation;

a ground wire having a cylindrical semi-conductive material covering same and in contact with said thin layer of conductive material along its length; and an insulating jacket covering said semi-conductive material and said conductive material for maintaining physical and electrical contact therebetween;

wherein the outer diameters of said semi-conductive material and said conductive material are approximately the same so that said insulating jacket forms an easily terminated substantially planar multi-conductor cable array.

2. Apparatus as set forth in claim 1, wherein the thickness of said layer of conductive material is less than 0.001 inch.

3. Apparatus as set forth in claim 1, wherein the thickness of said layer of conductive material is on the order of 0.0003–0.0004 inch.

4. Apparatus as set forth in claim 3, wherein said layer of conductive material comprises a metal.

5. Apparatus as set forth in claim 4, wherein said metal comprises silver.

6. Apparatus as set forth in claim 1, further comprising at least one unshielded wire assembly having an additional conductive wire covered by insulation.

7. Apparatus as set forth in claim 6, further comprising a second unshielded wire assembly substantially identical to said at least one unshielded wire assembly.

8. Apparatus as set forth in claim 6, wherein said semi-conductive material is positioned between said at least one unshielded wire assembly and said conductive material.

9. The cable as set forth in claim 1, further in combination with a miniature, modular plug adapted to receive and retain said cable, said plug including a plurality of insulation-piercing conductive terminals each adapted to make electrical contact with one of the wires of said cable.

10. The cable as set forth in claim 9, wherein said cable includes an exposed end portion not covered by said jacket, said conductive terminals adapted to pierce said insulation and said semi-conductive material in said exposed end portion of said cable.

11. The cable as set forth in claim 10, wherein an end of said insulation is stripped of said conductive material, said end portion being that portion of said insulation adapted to be pierced by one of said conductive terminals.

12. The cable as set forth in claim 9, wherein an end portion of said insulation is stripped of said conductive material, said end portion being that portion of said insulation adapted to be pierced by one of said conductive terminals.

13. A cable assembly, which comprises:

a cylindrical shielded wire assembly;

means for grounding said shielded wire assembly; and at least one cylindrical unshielded wire assembly;

wherein said shielded wire assembly comprises conductive wire means covered by insulation means, and means for shielding said wire means against electrical interference which comprises a layer of conductive material bonded to said insulation means;

said grounding means being in contact with said conductive material and comprising a ground wire covered by a cylindrical semi-conductive material that is in contact with said conductive material;

jacket means covering said shielded wire assembly, said semi-conductive material and said at least one unshielded wire assembly for maintaining same in a substantially planar array, said semi-conductive material being positioned between said shielded wire assembly and said at least one unshielded wire assembly; and wherein said at least one unshielded wire assembly comprises additional conductive wire means covered by additional insulation means, the diameters of said shielded wire assembly, said semi-conductive material and said at least one unshielded wire assembly being substantially the same.

14. The cable assembly as set forth in claim 13, further comprising a second unshielded wire assembly substantially identical to said at least one unshielded wire assembly and positioned adjacent same within said jacket means.

15. The cable assembly as set forth in claim 9, further in combination with a miniature, modular plug adapted to receive and retain said cable assembly, said plug including a plurality of insulation-piercing conductive terminals each adapted to make electrical contact with one of the center conductors of said cable assembly.

16. The cable assembly as set forth in claim 15, wherein said shielded wire assembly includes an end portion thereof stripped of said conductive material, said end portion being that portion of said shielded wire assembly adapted to be pierced by one of said conductive terminals.

17. The cable assembly as set forth in claim 13, wherein said cable assembly includes an exposed end portion not covered by said jacket means, said conductive terminals adapted to pierce said insulation means, said semi-conductive material and said additional insulation means in said exposed end portion of said assembly.

18. The cable assembly as set forth in claim 14, wherein said shielded wire assembly includes an end portion thereof stripped of said conductive material, said end portion being that portion of said shielded wire assembly adapted to be pierced by one of said conductive terminals.

* * * * *

UNITED STATES PATENT AND TRADEMARK OFFICE

CERTIFICATE OF CORRECTION

PATENT NO. : 4,314,737

DATED : February 9, 1982

INVENTOR(S) : Bogese, Charles E.; Bogese, Stephen B., II

It is certified that error appears in the above—identified patent and that said Letters Patent is hereby corrected as shown below: ON THE TITLE PAGE:

Delete "AND METHOD OF MAKING SAME" from the title.

In Column 6, line 15, after "substantially", insert --cylindrical--.

In Claim 15, line 1, delete "9" and insert --13--; in line 6, delete "of the center conductors" and insert --wire assembly--.

In Claim 17, line 1, delete "13" and insert --15--.

In Claim 18, line 1, delete "14" and insert --17--.

Signed and Sealed this

*Eleventh* Day of *May 1982*

[SEAL]

*Attest:*

GERALD J. MOSSINGHOFF

*Attesting Officer* *Commissioner of Patents and Trademarks*